US005708435A

United States Patent [19]

Kudo et al.

[11] Patent Number: 5,708,435

[45] Date of Patent: Jan. 13, 1998

[54] MULTILAYER WAVE ABSORBER

[75] Inventors: Toshio Kudo, Osaka; Hideaki Tamura, Arida; Kenichi Noda, Nagoya, all of Japan

[73] Assignees: Mitsubishi Cable Industries, Ltd.,, Hyogo; Ten Incorporated,, Aichi, both of Japan

[21] Appl. No.: 589,945

[22] Filed: Jan. 23, 1996

[30] Foreign Application Priority Data

Jan. 24, 1995 [JP] Japan ..... 7-009291

[51] Int. Cl.[6] ..... H01Q 17/00

[52] U.S. Cl. ..... 342/1; 342/4

[58] Field of Search ..... 342/1, 2, 3, 4

[56] References Cited

U.S. PATENT DOCUMENTS

| | | | |
|---|---|---|---|
| 3,720,951 | 3/1973 | Naito | 342/1 |
| 3,754,255 | 8/1973 | Suetake et al. | 342/1 |
| 3,887,920 | 6/1975 | Wright et al. | 342/1 |
| 3,938,152 | 2/1976 | Grimes et al. | 342/1 |
| 4,003,840 | 1/1977 | Ishino et al. | 342/1 |
| 4,012,738 | 3/1977 | Wright | 342/1 |
| 4,023,174 | 5/1977 | Wright | 342/1 |
| 4,118,704 | 10/1978 | Ishino et al. | 342/1 |
| 4,752,525 | 6/1988 | Oyachi et al. | 428/323 |
| 5,296,859 | 3/1994 | Naito et al. | 342/1 |
| 5,394,150 | 2/1995 | Naito et al. | 342/4 |
| 5,446,459 | 8/1995 | Kim et al. | 342/1 |
| 5,453,745 | 9/1995 | Kudo et al. | 342/1 |

FOREIGN PATENT DOCUMENTS

| | | |
|---|---|---|
| 323826 | 7/1989 | European Pat. Off. . |
| 1-439337 | 7/1991 | European Pat. Off. . |
| 35 34 059 | 5/1990 | Germany . |
| 879489 | 10/1961 | United Kingdom . |

*Primary Examiner*—John B. Sotomayor

*Attorney, Agent, or Firm*—Sughrue, Mion, Zinn, Macpeak & Seas, PLLC

[57] ABSTRACT

A wave absorber comprising a sintered ferrite tile wave absorber as a base substrate lowermost relative to the incident wave, and one or more laminates comprising two layers as one set, with a dielectric layer as a lower layer and a dielectric loss-causing layer as an upper layer, laminated on the base substrate. The wave absorber of the present invention is thin, but is capable of absorbing waves over wide frequency bands of from tens of megahertz to a dozen or so gigahertz. By making the absorber thin, the absorber weighs less and is easy to handle, which in turn leads to fine workability and low construction cost.

13 Claims, 6 Drawing Sheets

MULTILAYER WAVE ABSORBER

FIELD OF THE INVENTION

The present invention relates to a wave absorber.

BACKGROUND OF THE INVENTION

There has been conventionally known, as a broad-band wave absorber capable of absorbing waves over a wide frequency bend of from tens of megahertz to a dozen or so gigahertz, a wave absorber comprising, for example, an urethane wave absorber of about 1 m thickness adhered to the surface of sintered ferrite tiles.

A wave absorber of such structure is very thick and bulky to the extent that the use of such absorber in an anechoic chamber causes in low utilization of the space. In addition, the thickness and weight thereof necessitate higher material costs and working costs, as well as higher construction costs.

SUMMARY OF THE INVENTION

It is therefore an object of the present invention to provide a thin wave absorber capable of efficiently absorbing waves over a wide frequency band.

For the explanation's sake, a wave incident side of a wave absorber is referred to as an "upper side" or "upper layer side" and a base substrate side thereof is referred to as a "lower side" or "lower layer side" in this specification.

The wave absorber of the present invention comprises a sintered ferrite tile wave absorber as a base substrate which is placed at the lowermost side relative to an incident wave, and one or more laminates each consisting of two layers as one set of a dielectric layer (lower layer side) and a dielectric loss-causing layer (upper layer side) are laminated on this base substrate.

When two or more of the above-mentioned two-layer-one-set laminates are stacked, the upper dielectric loss-causing layer preferably has a dielectric loss factor of not more than that of the lower dielectric loss-causing layer.

In addition, the uppermost dielectric loss-causing layer preferably has a stepwisely or consecutively increasing dielectric loss from the upper layer toward the lower layer.

DETAILED DECEPTION OF THE INVENTION

The present invention is described in more detail in the following by way of illustrative examples.

Figure 1:
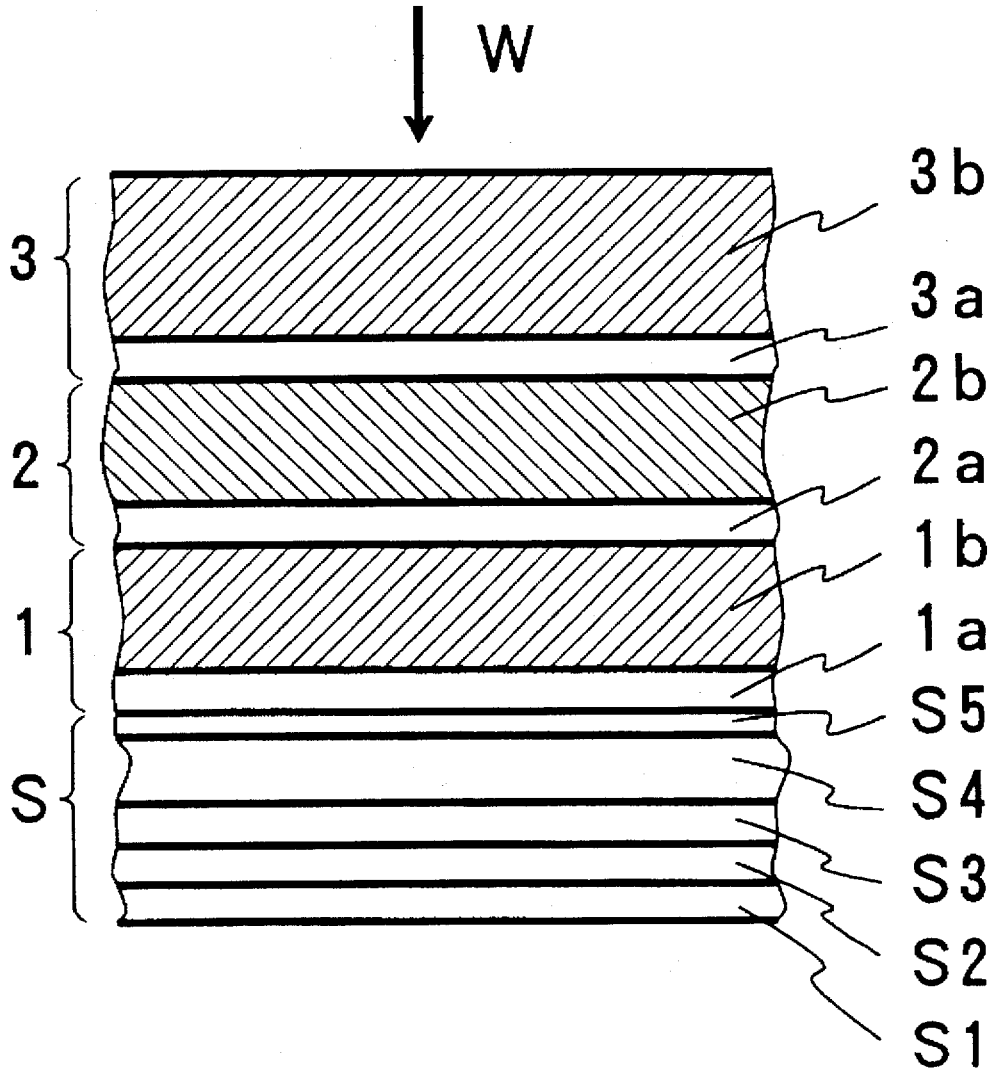
FIG. 1 schematically shows one example of the structure of the wave absorber of the present invention.

FIG. 1 schematically shows one example of the structure of the wave absorber of the present invention. In this Figure, the wave to be absorbed is shown with a bold arrow W which is coming into the absorber from the upper side of the Figure. The wave absorber of this example comprises a base substrate S and three laminates (1, 2, 3) respectively comprising a dielectric layer (lower layer) and a dielectric loss-causing layer (upper layer). The three laminates are accumulated on said substrate. These laminates 1, 2 and 3 each having two layers respectively comprise a dielectric layer 1*a*, 2*a* or 3*a*, and a dielectric loss-causing layer 1*b*, 2*b* or 3*b*. The dielectric loss-causing layer is hatched for easy recognition. In this example, the dielectric layers 1*a*, 2*a* and 3*a* are fiber assemblies. The base substrate S is a laminate of a low permittivity layer S2, a sintered ferrite tile layer S3, a low permittivity layer S4 and a rubber ferrite layer S5 sequentially laminated on a metallic reflector S1.

A dielectric loss-causing layer having a small dielectric loss factor is laminated as the uppermost layer. This enables introducing an incident wave W into a dielectric loss-causing layer 3*b* of a laminate 3 on the upper layer side, with the least reflection of the incident wave W at the incident surface. The incident wave W enters the next dielectric layer 3*a* upon being gently absorbed in part in the dielectric loss-causing layer 3*b*. The wave which entered the dielectric layer 3*a* attenuates during repetitive plural reflections in the interface between the two dielectric loss-causing layers which are located across this dielectric layer. In-so-doing, part of the wave which re-entered the upper layer exits the wave absorber as an unabsorbed wave. The wave which entered the lower side layer advances into the still lower layer while being absorbed as above, thereby being effectively absorbed.

This action is prominent particularly when a dielectric layer is interposed between two dielectric loss-causing layers in the upper layer side, and a dielectric layer is interposed between a dielectric loss-causing layer and a base substrate in the lower layer side. With this structure, an effective absorption is obtained over a wide frequency band.

A dielectric loss-causing layer consists of a fiber assembly formed by fibers applied with a conductive coating on their surface, or prepared from a resin foam treated with a conductive material.

Examples of the fiber assembly formed by fibers applied with a conductive coating on their surface include known fiber assemblies. The fiber assembly is a mat-shaped entangled mass of fibers having optional length, and may have melt-bonded intersections of fibers; may comprise fibers adhered to one another with an adhesive material at the intersections of fibers; or may be able to retain a stable mat shape by merely entangling the fibers.

Examples of the resin foam treated with a conductive material include a foam of polymer added with a conductivity-imparting agent such as carbon, which is exemplified by polyurethane foam and polystyrene foam.

As the fibers to form a fiber assembly, usable are natural fibers such as cotton and hemp, and organic polymer fibers such as organic synthetic fibers. While the kind of the organic synthetic fiber is not particularly limited, preferred are, for example, polar organic synthetic fibers having a permittivity of not less than 2.8. Specific examples thereof include polyvinylidene chloride, nylon, polyester and polyacryl, with preference given to polyvinylidene chloride in view of flame resistance and weatherability.

While the thickness of the fiber may be single, it is preferable that two or more kinds of fibers having different thickness are used in combination. For example, a combination of a small diameter fibers of 50–200 denier in a proportion of 10–90% by weight and a large diameter fibers of 500–1,200 denier in a proportion of 90–10% by weight is employed.

As the conductive coating, those containing a conductivity-imparting agent and capable of forming a film causing dielectric loss on the fiber surface by applying and drying are usable. For example, a mixture of an organic polymer latex and an aqueous conductive coating is preferable.

Examples of the organic polymer latex include emulsions of various organic polymers, with preference given to those having fine adhesive effect on the organic polymer fiber constituting the wave absorber. When the organic .polymer fiber is polyvinylidene chloride, for example, an emulsion of polyvinylidene chloride and an emulsion of a mixture of polyvinylidene chloride and polyvinyl chloride are preferable. The solid content of the organic polymer latex is preferably 10–80% by weight, particularly about 20–70% by weight.

As the aqueous conductive coating, an aqueous coating containing a binder and a conductivity-imparting agent is used. The binder is exemplified by inorganic binders such as clay, bentonite, mica, silicate and diatom earth, and organic binders such as polyvinyl alcohol and acrylic resin. It is particularly preferable that the binder be a fine powder, and can disperse in a colloidal form. Examples of the conductivity-imparting agent include graphite, carbon and conductive metallic powders.

The solid content of the aqueous conductive coating is about 10–50% 50% by weight, and a coating capable of affording a dry film having an electric resistance at room temperature of about 10–50 Ω/sq (□) at s film thickness of 25 μm is preferable.

The mixing ratio of the above-mentioned organic polymer latex and an aqueous conductive coating is generally 5–500 parts by weight, preferably about 10–200 parts by weight, of the organic polymer latex relative to 100 parts by weight of the aqueous conductive coating.

The more detailed production examples and properties of the above-mentioned conductive costing and fiber assembly applied with the same are shown in Japanese Patent Unexamined Publication No. 234092/1991 entitled Wave Absorbor.

While the dielectric layer in the example of FIG. 1 is composed of a fiber assembly without conductivity coating, the dielectric layer is not limited to such mode, and those made from a material having a low permittivity such as a resin foam (e.g., hard polyurethane foam and polystyrene foam) suffice for use.

The permittivity of the dielectric layer is 1.1–3.0, particularly about 1.1–1.5. The materials and the degree of foaming are appropriately determined to achieve the above-mentioned permittivity.

When the dielectric layer is formed from a fiber assembly, the fibers to be the element thereof and the means of assembling the fibers are completely the same as those for the fiber assembly constituting the above-mentioned dielectric loss-causing layer.

While the method for adjoining the dielectric layer formed from the fiber assembly and the dielectric loss-causing layer is not particularly limited, exemplified is a method comprising adhering them with an adhesive. Examples of the adhesive include epoxy, isocyanate, cyanoacrylate, hot-melt and rubber adhesives.

When two or more two-layer-one-set laminates are stacked, the upper dielectric loss-causing layer preferably has a dielectric loss of not more than that of the lower dielectric loss-causing layer. This enables more preferable entrance of the wave from the surface of the uppermost layer and more preferable absorption of the wave inside. A method for producing different dielectric losses includes varying the composition of the conductive coating between the upper and the lower layers.

It is preferable that the thickness of the dielectric loss-causing layer in the upper layer side be not less than the thickness of the dielectric loss-causing layer in the lower layer side, in addition to the above-mentioned conditions. This enables introduction of the incident wave into the absorber without impairing the absorption characteristic of the base substrate with respect to the lower frequency band waves, as well as efficient absorption of higher frequency band waves.

The composition of the conductive coating may be varied by changing the mixing ratio of the water soluble conductive coating and latex in such a manner that the proportion of the aqueous conductive coating increases from the upper layer to the lower layer.

The preferable mixing ratio (% by weight) of the water soluble conductive coating and latex of the conductive coating applied on each dielectric loss-causing layer, and preferable combinations of the thickness of respective dielectric loss-causing layers when three two-layer-one-set laminates are accumulated as shown in FIG. 1 are shown in Table 1.

Also, preferable exemplary combinations when two two-layer-one-set laminates are used are shown in Table 2.

The number of the two-layer-one-set laminates to be accumulated and the upper limit of the thickness of the entire layer are not particularly limited. However, in view of the fact that a greater number of laminates does not result in similarly greater effects of wave absorption but rather, the effects reach an equilibrium at a certain point, and that a difficulty will be caused by the decreased usable space left by the thick absorber, laminating about 4 laminates will be preferable. In particular, stacking 2 or 3 laminates as shown above simultaneously affords preferable effects of wave absorption and a thin structure.

The base substrate is formed using a wave absorber comprising a sintered ferrite tile material, and known ones having such structure serve well for this end.

According to the wave absorber of the present invention, the two-layer-one-set laminate absorbs mainly the waves of higher frequency bands of above about several gigahertz out from the range of from tens of megahertz to about a dozen gigahertz. Thus, the base substrate is preferably one capable of mainly absorbing the waves of lower frequency bands below about several gigahertz, whereby effective wave absorption as a whole over wide frequency bands is achieved.

In the example of FIG. 1, a laminate of a layer having a low permittivity and a layer having a high magnetic loss, which were alternatively laminated, was used as a base substrate, wherein the layer having a low permittivity was a hard polyurethane foam having a relative permittivity of about 1.2, and the layer having a high magnetic loss comprised a known sintered ferrite tile as a layer S3 and a rubber ferrite as a layer S5.

Examples of other wave absorber preferably used as a base substrate include those described in U.S. Pat. No. 5,276,448.

As shown in the instant example, the base substrate has a metallic reflector at the lowermost layer. The material of the metallic reflector includes all metals capable of reflecting waves, such as iron, copper, yellow copper, nickel and zinc-plated iron plate.

The wave absorber of the structure shown in FIG. 1 was actually configurated and the wave absorption characteristic was confirmed.

Experimental Example 1

In this Example, a laminate comprising a layer having a low permittivity, a sintered ferrite tile layer, a layer having a low permittivity and a rubber ferrite layer accumulated in this order on a metallic reflector plate was used as a base substrate. Three two-layer-one-set laminates were laminated on this base substrate to form a wave absorber having a total thickness of about 210 mm, and its properties were investigated.

The material, size and other construction of this wave absorber are shown in Table 1.

TABLE 1

| | | Thickness (mm) | Bulk density (kg/mm³) | Water soluble conductive coating: latex | Conductivity-imparting agent |
|---|---|---|---|---|---|
| Laminate 3 | Dielectric loss-causing layer | 50 | 40 | 0.6:1.1 | carbon, graphite |
| | Dielectric layer | 10 | 40 | — | — |
| Laminate 2 | Dielectric loss-causing layer | 50 | 40 | 0.6:1.1 | carbon, graphite |
| | Dielectric layer | 10 | 40 | — | — |
| Laminate 1 | Dielectric loss-causing layer | 25 | 40 | 0.73:1.1 | carbon, graphite |
| | Dielectric layer | 20 | 40 | — | — |

| | | Thickness (mm) | Material and construction |
|---|---|---|---|
| Base substrate S | Rubber ferrite | 0.5 | Ni—Zn powder ferrite |
| | Layer with low dielectric constant | 35.0 | hard polyurethane foam |
| | Sintered ferrite | 5.2 | Ni—Zn sinterd ferrite tile |
| | Layer with low dielectric constant | 5.0 | hard polyurethane foam |
| | Metallic reflector | 3.2 | zinc-plated iron plate |

Figure 3:
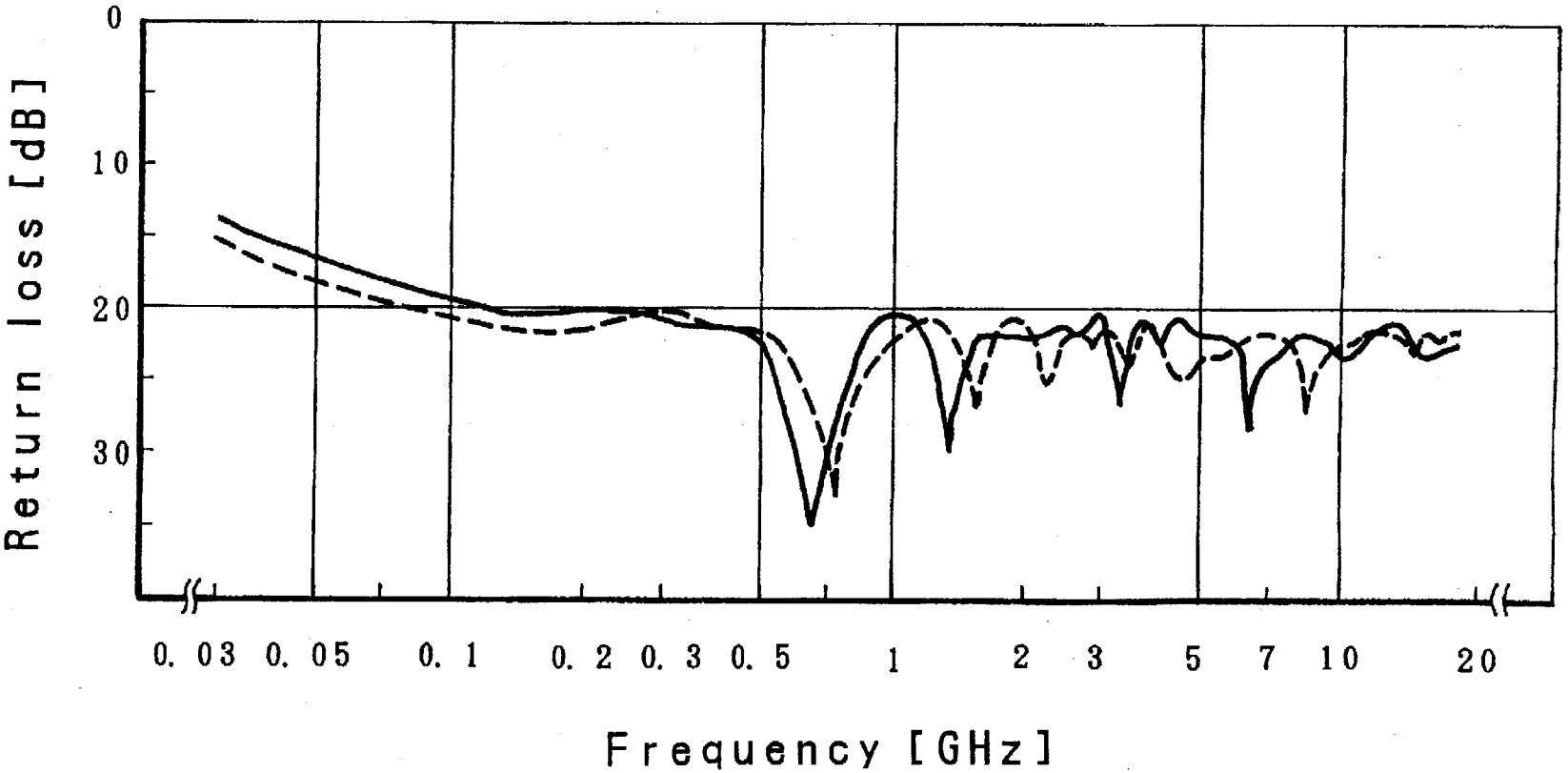
FIG. 3 is a graph showing the wave absorption characteristic of the wave absorber of the present invention.

The return loss of the wave at respective frequencies by the use of this wave absorber was determined. As a result, the wave showed the property depicted in the graph of FIG. 3 with a solid line.

Experimental Example 2

Figure 2:
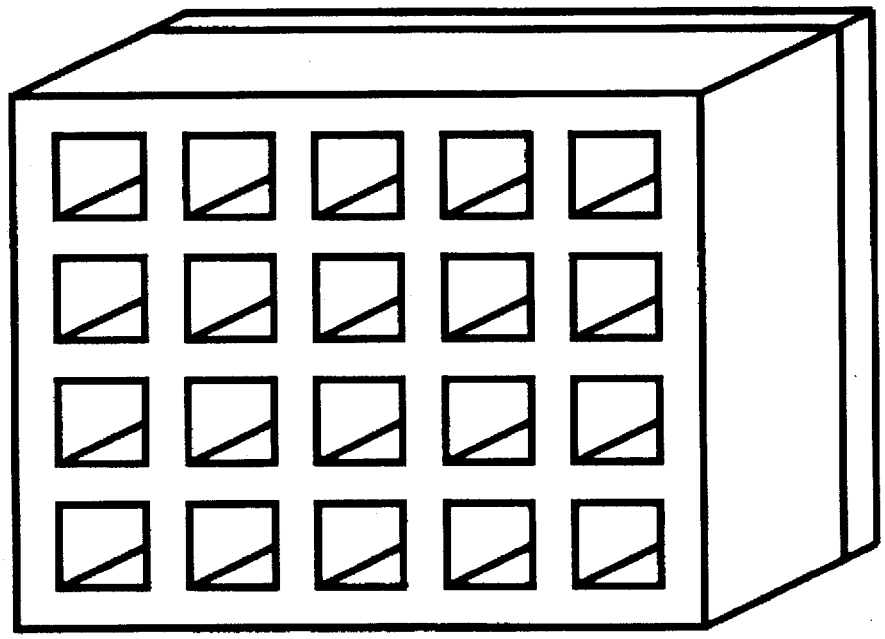
FIG. 2 PRIOR ART
FIG. 2 is a perspective view which schematically shows one example of the structure of a lattice ferrite tile base substrate.

In this Example, a laminate comprising a lattice ferrite tile accumulated on a metallic reflector plate was used as a base substrate. Two two-layer-one-set laminates were accumulated on this base substrate to form a wave absorber having a thickness of about 180 mm, and its properties were investigated. The lattice ferrite tile had an appearance as shown in the perspective view of FIG. 2.

The material, size and other construction of this wave absorber are shown in Table 2.

TABLE 2

| | | Thickness (mm) | Bulk density (kg/m³) | Water soluble conductive coating:latex | Conductivity imparting agent |
|---|---|---|---|---|---|
| Laminate 2 | Dielectric loss-causing layer | 100 | 40 | 0.54:1.0 | carbon, graphite |
| | Dielectric layer | 10 | 40 | — | — |
| Laminate 1 | Dielectric loss-causing layer | 25 | 40 | 0.70:1.0 | carbon, graphite |
| | Dielectric layer | 25 | 40 | — | — |

| | | Thickness (mm) | Material and construction |
|---|---|---|---|
| Base substrate S | Lattice ferrite tile | 17.0 | Ni—Zn sinterd ferrite tile |
| | Metallic reflector | 3.2 | zinc-plated iron plate |

The return loss of the wave at respective frequencies by the use of this wave absorber was determined. As a result, the wave showed the property depicted in the graph of FIG. 3 with a broken line.

As is apparent from the above results, the wave absorbers of Experimental Examples 1 and 2 both exhibited superior wave absorbing effect of not less than 20 dB in the wave frequency band of not less than about 90 MHz.

The particularly preferable wave absorbers from the various modes of the wave absorbers of the present invention are shown in the following.

Figure 4:
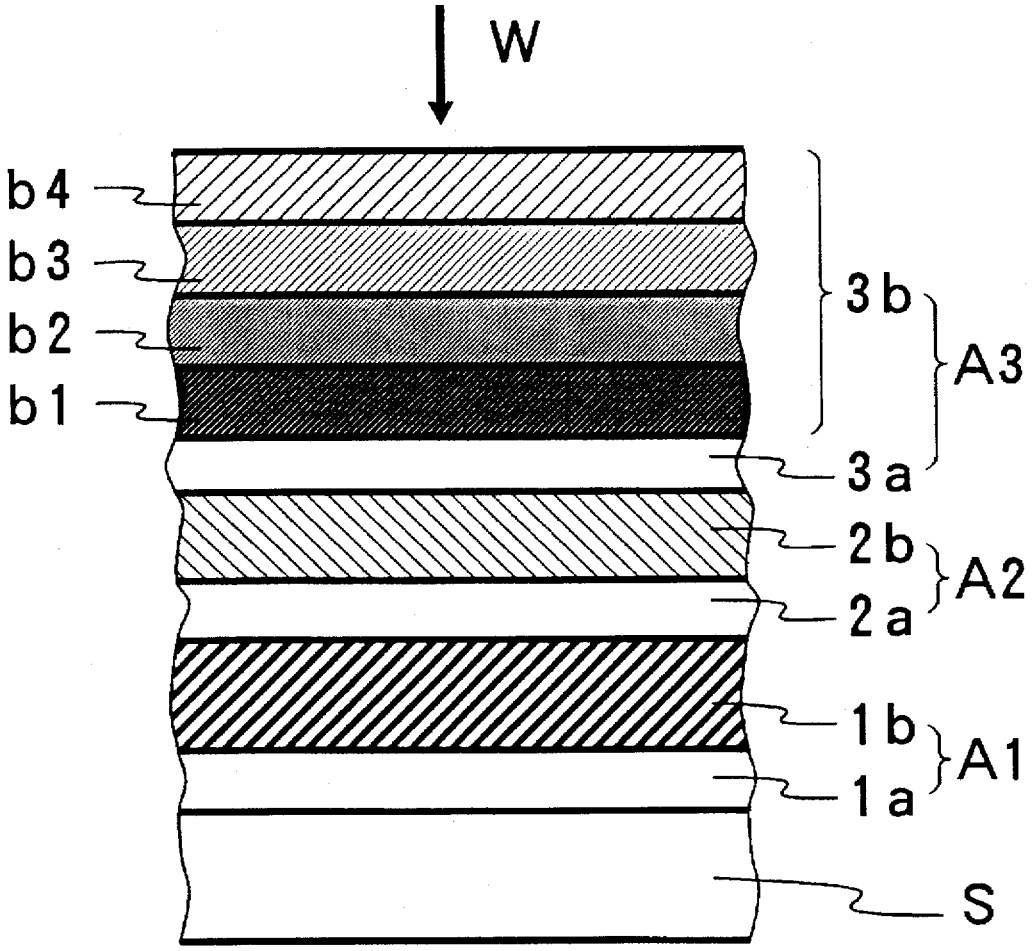
FIG. 4 schematically shows preferable example of the structure of the wave absorber of the present invention.

As shown in FIG. 4, two-layer-one-set laminates A1, A2 and A3 are sequentially accumulated on the base substrate S, with the dielectric layer placed on the lower layer side and the dielectric loss-causing layer placed on the upper layer side. These two-layer-one-set laminates A1, A2 and A3 respectively have dielectric layers 1*a*, 2*a* and 3*a*, and dielectric loss-causing layers 1*b*, 2*b* and 3*b*. The dielectric loss-causing layer are provided with hatching for easy recognition. Of these laminates, the dielectric loss-causing layer 3*b* (hereinafter referred to as uppermost dielectric loss-causing layer) belonging to the uppermost laminate A3 consists of 4 layers (b4, b3, b2 and b1), so that the dielectric loss is increased in steps from the upper layer to the lower layer in this layer 3*b*.

The structure wherein the uppermost dielectric loss-causing layer allows stepwise or consecutive increase in the dielectric loss from the upper layer side to the lower layer side in said layer leads to suppressed reflection of wave W at the surface of the uppermost dielectric loss-causing layer 3*b*, by the action of the surface layer b4 having lower dielectric loss, and introduction of greater amount of incident wave into the lower layers. On the other hand, the layer b1 having a higher dielectric loss affords sufficient reflection of the wave which entered the dielectric layer 3*a* toward the lower side of the absorber.

The wave which entered this wave absorber enters the dielectric layer 3*a* after being absorbed in the uppermost dielectric loss-causing layer 3*b*, attenuates by the desirable multiple reflections, as in the case of FIG. 1, advances to the lower layers and is effectively absorbed in the course of repetitive multiple reflections.

The dielectric loss-causing layer is completely the same as that used in FIG. 1.

The uppermost dielectric loss-causing layer may be any as long as it can be formed to show increasing dielectric loss from the upper side to the lower side of this layer.

When the dielectric has a dielectric loss, the permittivity $\epsilon$ can be expressed by complex permittivity of the formula: $\epsilon'-j\epsilon''$. An increased dielectric loss means an increased value of loss factor $\epsilon''/\epsilon'(=\tan\delta)$.

The method for varying the dielectric loss includes, for example, varying the concentration of conductivity-imparting agent in the conductive coating to be applied to the fiber assembly, varying the bulk density of the fiber assembly and resin foam, or varying the thickness of the coated layer.

For stepwisely varying the dielectric loss of the uppermost dielectric loss-causing layer, for example, a necessary number of layers having various dielectric loss constants are laminated.

For stepwisely varying the dielectric loss, for example, a fiber assembly formed in such a manner that the bulk density is consecutively changed in the laminating direction is used.

When stepwise changes of the increase in the dielectric loss of the uppermost dielectric loss-causing layer is desired, the number of the steps is preferably 2 to 7, with particular preference given to 2 to 4 in view of the wave absorption characteristic and production cost.

The thickness of the uppermost layer is made not less than the thickness of the lower layer, and the thickness of the layers is made to decrease from the upper layer to the lower layer, so that the permittivity distribution equivalent to that of a pyramid structure is realized. As a result, superior absorption characteristic over wide frequency bands can be attained.

The dielectric layer may be any as long as it is prepared from the material having a lower permittivity than that of the dielectric loss-causing layer. Preferred is one having a permittivity similar to that of the air, which corresponds to complex permittivity of 1.0–1.1 in the real part and about 0.0–0.1 in the imaginary part. The complex permittivity is determined with respect to the wave of 500 MHz, hereinafter the same.

The material of the dielectric layer includes, for example, fiber assembly and resin foam (e.g., hard polyurethane foam and polystyrene foam), as in the case of FIG. 1.

The dielectric layer may be formed using the air (air layer).

Figure 6:
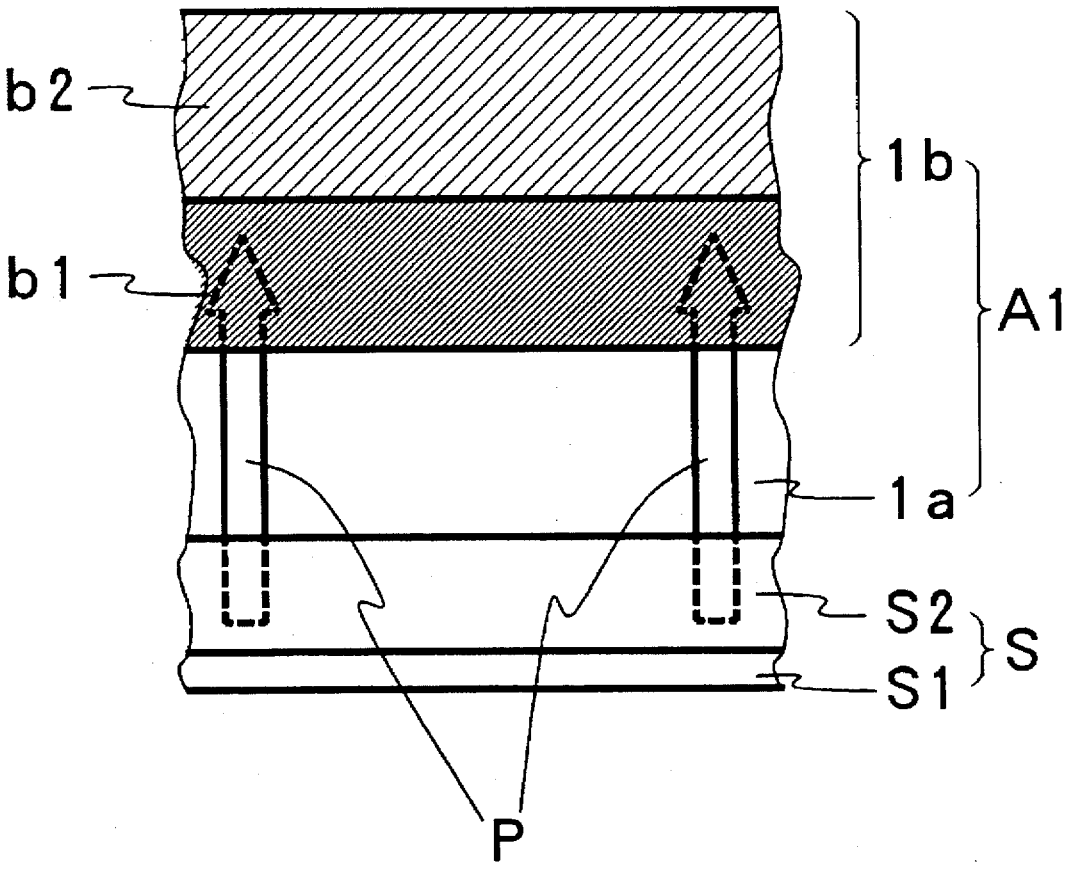
FIG. 6 schematically shows one example of the structure of an air layer which forms a dielectric layer in the present invention.

For forming an air layer as one layer in the laminate structure of said wave absorber, a spacer P may be formed as shown in FIG. 6 to secure the gap for an air layer (=dielectric layer 1*a*). In-so-doing, the spacer is preferably made ignorable in terms of permittivity by, for example, minimizing the cross section of the spacer, so that the dielectric layer can substantially contain only the air.

The spacer can have a columnar shape as shown in FIG. 6. The cross section of the column may be round, square or other shape. When it is square, the ratio of the two different sides is not critical.

While the method for connecting .the spacer and the layers above and under the air layer is not particularly limited, for example, one end of the spacer is inserted into a corner of the lower side layer (base substrate S in the Figure) to stand the spacer and the wedge formed on the other end of the spacer is inserted into the corresponding corner of the upper layer (layer b1 under the dielectric loss-causing layer in the Figure) to fix the spacer.

While the number of the two-layer-one-set laminate to be used and the upper limit of the thickness of the entire layer are not particularly limited, it is preferable to laminate 4 or so for the same reasons given in the above with respect to FIG. 1.

Figure 5:
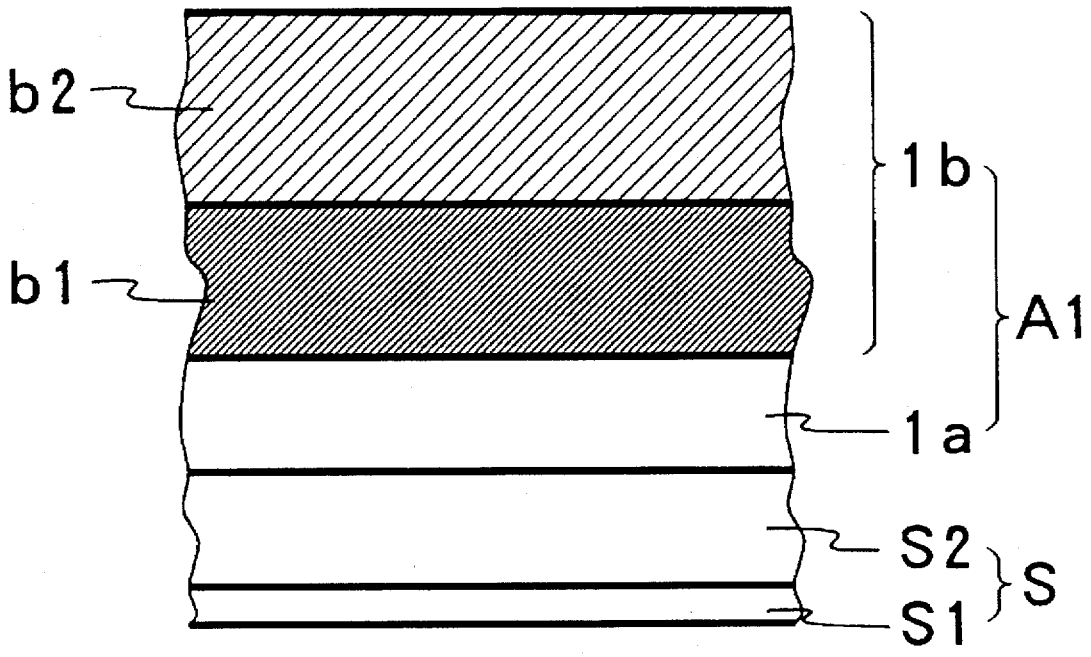
FIG. 5 schematically shows more preferable example of the structure of the wave absorber of the present invention.

For a substantial absorption effect (e.g., about 15–20 dB), for example, the number of the two-layer-one-set laminate may be one, as shown in FIG. 5.

When one two-layer-one-set laminate was used and the dielectric loss in the dielectric loss-causing layer was changed in two steps, as shown in FIG. 5, the preferable permittivity of the dielectric layer is, when expressed in complex permittivity, preferably about 1.0–1.1 in the real part and about 0–0.1 in the imaginary part. As mentioned above, the dielectric layer may be an air layer (gap).

Similarly, the preferable permittivity of the upper dielectric loss-causing layer is, when expressed in complex permittivity, preferably about 1.2–1.45 in the real part and about 0.15–0.25 in the imaginary part, and the preferable permittivity of the lower dielectric loss-causing layer is preferably about 1.45–1.60 in the real part and about 0.25–0.50 in the imaginary part, at which the reflection at the absorber surface can be reduced.

In the case of FIG. 5, the thickness of the upper dielectric loss-causing layer is preferably 60–120 mm and 30–60 mm in the lower side layer.

In this case, the thickness of the dielectric layer is preferably not more than 50 mm. The thickness of the dielectric layer may be ignorably small and the layer can be replaced by the adhesive layer for adhering the dielectric loss-causing layer and the base substrate. For an improved absorption characteristic in the 1,000 MHz±300 MHz band, the thickness is preferably not less than 10 mm.

The preferable mode of the base substrate is, for example, sintered ferrite tile alone. However, a laminate may be used which comprises layers having a low permittivity and layers comprising a sintered ferrite tile and having a high magnetic loss, which layers being alternatively laminated as in FIG. 1.

Experimental Example 3

The wave absorber of the structure shown in FIG. 5 was actually configurated and the wave absorption characteristic was confirmed.

In this Example, a laminate comprising a sintered ferrite tile layer S2 accumulated on a metallic reflector plate S1 was used as a base substrate S. One two-layer-one-set laminate A1 was laminated on this base substrate. The dielectric loss-causing layer 1*b* of the laminate A1 has a dielectric loss increased in two steps from the upper layer to the lower layer. Each layer as shown in FIG. 5 is designed as follows.

① dielectric loss-causing layer 1*b* upper layer b2; Fiber assembly of 1,000 denier vinylidene chloride fibers (bulk density 40 kg/m$^3$) applied with conductive coating on the fiber surface. The conductivity-imparting agents in the conductive coating were carbon and graphite. Thickness 100 mm, complex permittivity 1.3–j0.2.

lower layer b1; The same fiber assembly as that for the upper layer b2, applied with conductive coating at higher concentration of the conductivity-imparting agent, on the fiber surface. Thickness 50 mm, complex permittivity 1.5–J0.3.

② dielectric layer 1*a;*

Fiber assembly (bulk density 40 kg/m$^3$) of 1,000 denier vinylidene chloride fibers. Thickness 40 mm, complex permittivity 1.02–j0.02.

③ base substrate S;

sintered ferrite tile layer S2;

Lattice Ni—Zn sintered ferrite tile, thickness 19 mm.

metallic reflector S1;

Zinc-plated iron plate, thickness 3.2 mm.

The return loss of waves at various frequencies by the use of this wave absorber was determined to find that superior wave absorption of 15–20 dB in the entire band of from 30 MHz to 18 GHz.

As has been explained, the wave absorber of the present invention is thin, but is capable of absorbing waves over wide frequency bands of from tens of megahertz to a dozen or so gigahertz. By making the absorber thin, the absorber weighs less and is easy to handle, which in turn leads to fine workability and low construction cost.

What is claimed is:

1. A wave absorber comprising a sintered ferrite tile wave absorber as a base substrate lowermost relative to the incident wave, and one or more laminates each comprising a dielectric layer and a dielectric loss-causing layer, wherein said dielectric layer is positioned between said sintered ferrite tile and said dielectric loss-causing layer, said dielectric loss-causing layer comprises a lower side and an upper side, said laminates are arranged such that an upper laminate is placed directly above a lower laminate, and said dielectric loss-causing layer in said upper laminate is an uppermost dielectric loss-causing layer.

2. The wave absorber of claim 1, comprising two or more laminates, wherein the dielectric loss of the dielectric loss-causing layer of said upper laminate is not greater than that of the dielectric loss-causing layer of said lower laminate.

3. The wave absorber of claim 2, wherein the thickness of the upper dielectric loss-causing layer is not less than that of the lower dielectric loss-causing layer.

4. The wave absorber of claim 1, wherein the dielectric loss-causing layer is formed from a fiber assembly of fibers applied with a conductive coating on their surface.

5. The wave absorber of claim 1, wherein the dielectric loss-causing layer is formed from a resin foam treated with a conductive material.

6. The wave absorber of claim 1, wherein the dielectric layer is formed from a fiber assembly or a resin foam.

7. The wave absorber of claim 1, wherein the dielectric layer substantially comprises only the air.

8. The wave absorber of claim 1, wherein the uppermost dielectric loss-causing layer is formed in such a manner that it has stepwisely or consecutively increasing dielectric loss from the upper side to the lower side in said layer.

9. The wave absorber of claim 7, comprising one laminate, wherein the dielectric layer has a complex permittivity of 1.0–1.1 in the real part and 0–0.1 in the imaginary part, the dielectric loss-causing layer has a dielectric loss increasing in two steps from the upper side to the lower side in said layer, the upper side having a complex permittivity of 1.2–1.45 in the real part and 0.15–0.25 in the imaginary part, and the lower side having a complex permittivity of 1.45–1.60 in the real part and 0.25–0.50 in the imaginary part, provided that the complex permittivity is measured with respect to a wave of 500 MHz.

10. The wave absorber of claim 8, comprising one laminate wherein the thickness of the dielectric layer in the laminating direction is not more than 50 mm.

11. The wave absorber of claim 8, wherein the dielectric loss-causing layer is formed from a fiber assembly of the fibers applied with a conductive coating on their surface, and the uppermost dielectric loss-causing layer has an increased dielectric loss achieved by increasing the concentration of the conductivity-imparting agent in the conductive coating.

12. The wave absorber of claim 1, wherein the base substrate comprises a lattice ferrite tile layer.

13. The wave absorber of claim 1, wherein the base substrate comprises a laminate comprising a low dielectric layer, a sintered ferrite tile layer, a low dielectric layer and a rubber ferrite layer laminated in this order.

* * * * *